United States Patent [19]

Plegat

[11] 4,094,184

[45] June 13, 1978

[54] MACHINE FOR FORMING JOINING PIPES

[75] Inventor: Alain Edouard Plegat, Asnieres, France

[73] Assignee: Societe Anonyme des Usines Chausson, Asnieres, France

[21] Appl. No.: 618,052

[22] Filed: Sep. 30, 1975

[30] Foreign Application Priority Data

Oct. 16, 1974 France ..... 74 34835

[51] Int. Cl.[2] ..... B21D 41/02

[52] U.S. Cl. ..... 72/392

[58] Field of Search ..... 72/392, 393, 293, 316, 72/318, 323; 269/47, 48, 49, 287

[56] References Cited

U.S. PATENT DOCUMENTS

| | | | |
|---|---|---|---|
| 62,852 | 3/1867 | Jennings | 72/392 |
| 2,230,071 | 1/1941 | Anderson et al. | 269/287 X |
| 2,687,763 | 8/1954 | Perkins | 72/392 |
| 2,812,002 | 11/1957 | Grotnes | 72/392 |

FOREIGN PATENT DOCUMENTS

| | | | |
|---|---|---|---|
| 1,035,813 | 7/1966 | United Kingdom | 72/392 |

*Primary Examiner*—Leon Gilden
*Attorney, Agent, or Firm*—Browdy and Neimark

[57] ABSTRACT

The machine comprises a fixedly mounted holder maintaining the pipe in a position so that the end thereof which is to be formed extends in a horizontal plane. Two complementary or mating pins are insertable in this end of the pipe. Supporting and driving means are provided for moving the two pins in opposite directions for a distance corresponding to the deformation to be given to this end of the pipe.

9 Claims, 13 Drawing Figures

Fig.7.
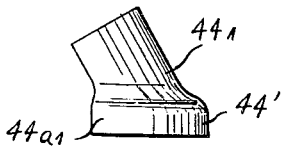
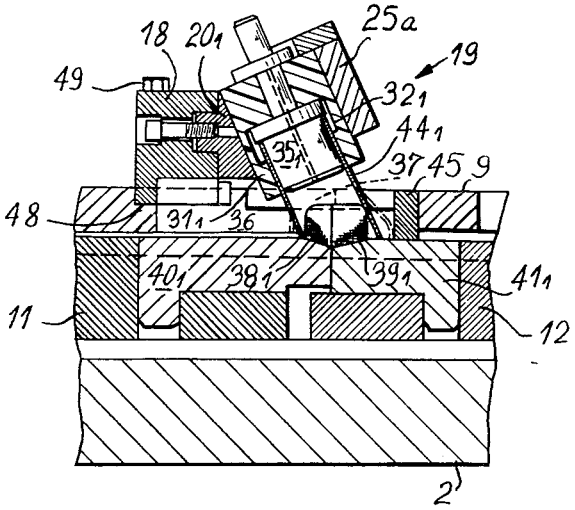
Fig.4.
Fig.8.
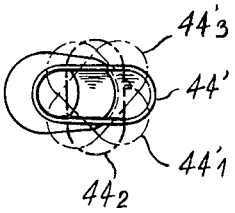
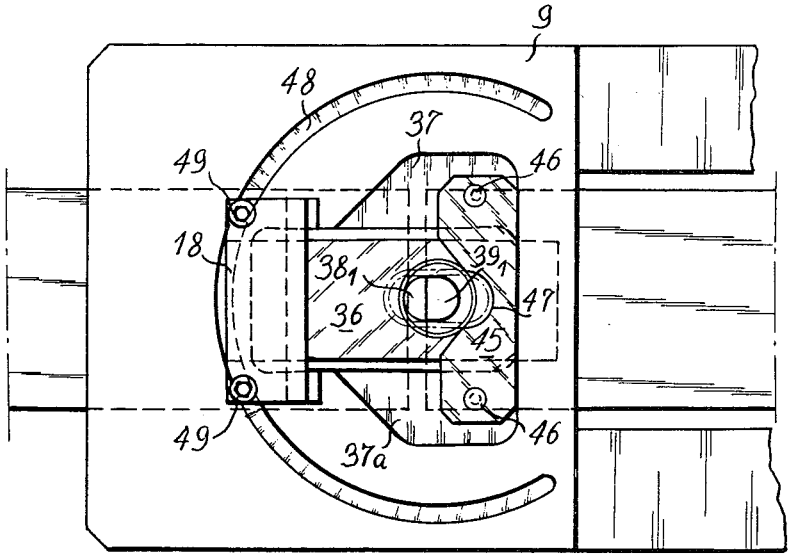
Fig.5.

MACHINE FOR FORMING JOINING PIPES

The present invention relates to the forming of pipes and more particularly to the forming of pipes used in heat exchangers of the type of cooling and heating radiators for motor cars. In this kind of apparatus, pipes are connected especially to header boxes and these pipes are fixed to the header boxes by tin soldering in case of apparatus made of heavy metals or by brazing in case of apparatus made of light alloys.

The pipes are often difficult to place because, in many manufactures, the header boxes are of a small height or the radiators which comprise the header boxes are placed in the vicinity of other components, for example a condenser for an air conditioning circuit, and that often requires the manufacture of pipes having an oblong portion at the level of their junction with the header box or other similar components.

To form an oblong end on a pipe which, in other respects, is of a circular cross-section, the previous art has shown the crushing of the end of the pipe: this is sometimes satisfactory when the pipe is placed perpendicularly to the header box. However, if the pipe must form a non-right angle with the header box and if it is consequently necessary to cut the oblong portion which is formed, then, a portion of the oblong wall of the pipe does not extend any more perpendicularly to the header box, which prevents performance of a good soldering or of a good brazing and makes more complicated the performance of the centering flange that must have the header box to receive the pipe.

To cope with this disadvantage, it has been necessary to manufacture pipes in two half-shells which are stamped and assembled together by soldering or brazing. This procedure complicates the manufacture and, consequently increases the cost.

The present invention relates to a new machine which enables the manufacture of an oblong portion at the end of pipes in such a way that the wall of the oblong portion can always apply perpendicularly on the header box and that whatever be the angle which has to form the pipe with respect to the header box.

Besides, the invention makes possible the forming of the oblong portion so that its major axis can be any angle with respect to the longitudinal axis of the pipe.

According to the invention, the machine comprises a fixedly mounted holder maintaining the pipe in a position so that the end thereof which is to be formed extends in a horizontal plane; two complementary or mating pins which are inserted in the end of the tube; and supporting and driving means for moving the two pins in opposite directions for a distance corresponding to a deformation to be given to the end of the pipe.

Various other features of the invention are moreover shown in the following detailed description.

Embodiments of the invention are shown by way of nonrestrictive examples in the accompanying drawings, wherein:

FIG. 1 is a partial longitudinal cross-section of the pipe forming machine;

FIGS. 1*a* and 1*b* are enlarged partial cross-sections of a detail of FIG. 1;

FIG. 4 is a partial cross-sectional view of a variant of the machine of FIG. 1;

FIG. 5 is a plane view corresponding to FIG. 4 showing particular components of the variant according to this Figure.

FIGS. 7 - 11 are diagrammatic representations of pipes formed by the machine of the above figures.

Figure 2:
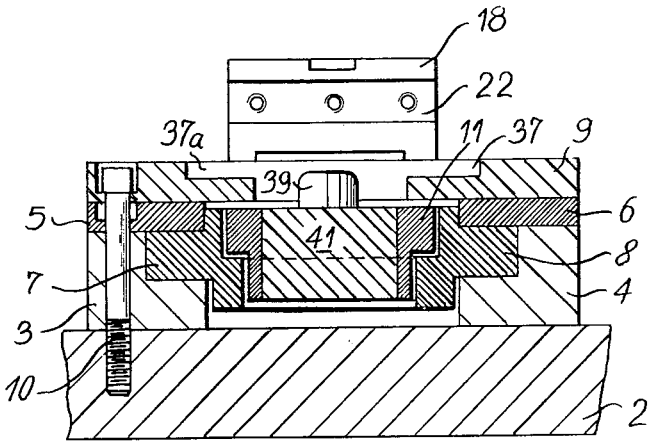
FIG. 2 is a cross-sectional view taken substantially along line II—II of FIG. 1.

Referring now to the drawings, the machine comprises a supporting plate 1 on which is fixedly mounted a platen 2. The platen 2 is used to support longitudinal girders 3, 4 substantially in a corner shape and covered with plates 5, 6. The plates 5, 6 delimit, with the longitudinal girders, a holder for maintaining slides 7, 8. The plates 5, 6 are themselves covered by a table 9; and the unit comprising the table, plates and longitudinal girders is fixedly mounted on the platen 2 by bolts, as shown at 10 (FIG. 2).

The slides 7, 8 are used as guides for two coaxial slides 11, 12 which are respectively connected to the piston rods 13, 14, respectively, of two cylinders 15, of which only one is shown. Adjustable abutments 16 are provided on each side of the cylinders 15, these abutments being supported by the plate 1.

The body of the cylinders 15 is connected to the table 9 by cross-pieces 17.

The top of the table 9 is rigidly connected to a fixing block 18 used for the removable mounting and support of a holder generally designated at 19. The holder 19 comprises a fixed arm 20 forming a small centering bar 21 engaged in a groove 22 of the block 18, and bolts 23 ensure the fixing of the fixed arm 20 of the holder with the block 18.

At one end, the fixed arm 20 forms a yoke (FIG. 3) crossed through by an axle 24 and used for the articulation of a mobile arm 25. The arm 25 can be locked with the fixed arm 20 by a tightening nut 26 screwed on a threaded rod 27 hinged on an axle 28, which is itself carried by the other end of the fixed arm 20; the other end forming also a yoke. The fixed and mobile arms 20 and 25 have semi-circular recesses 29 and 30 respectively, in which are housed two half-sockets 31 and respectively 32, which can be made of synthetic resin or of a polished metal. The two half sockets 31, 32 are partly closed at their upper portion as shown at 31*a*, 32*a* to support a core 35 by means of flanges 33, 34.

The table 9 has an aperture 36 provided beneath the holder 19, and flat recesses 37, 37*a* on each of the lateral sides of the aperture 36. Two pins 38, 39 protrude in the aperture 36, said pins 38, 39 being respectively formed from substantially right-angled parts 40, 41 which are inserted in recesses 42, 43 respectively of the slides 11, 12 to make easy replacement of the same. The pins 38, 39 are shaped in a complementary or mating way as shown in the drawings.

Figures 1, 1A, 1B, 6:
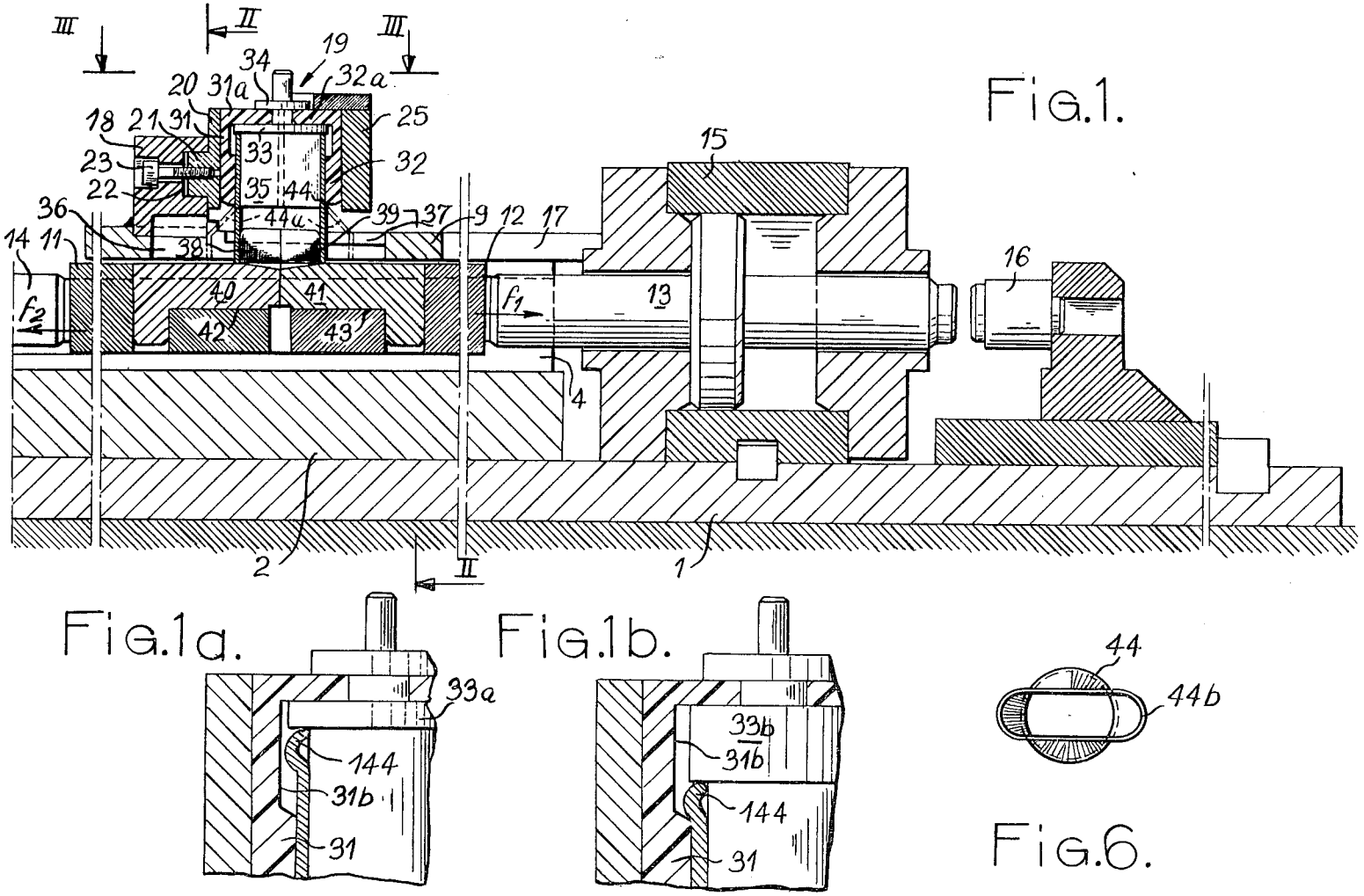
FIG. 6 is an end view of a pipe shaped according to the invention.
Figure 3:
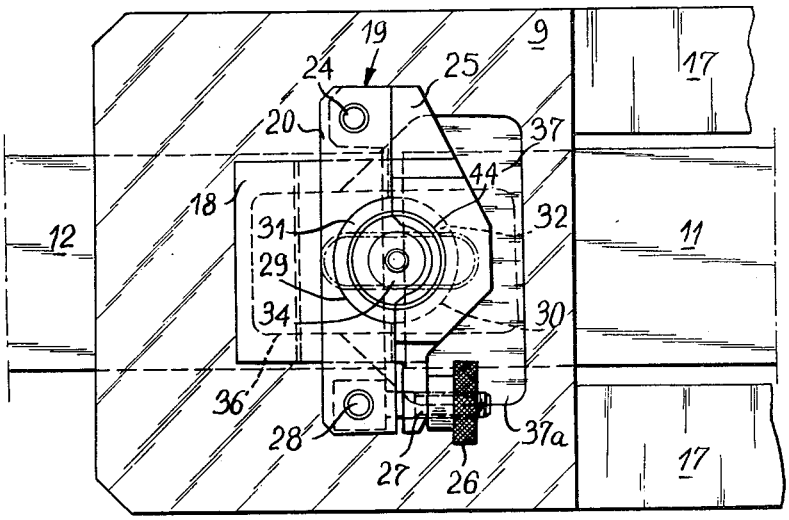
FIG. 3 is a partial plane view seen from line III—III of FIG. 1.

In FIGS. 1 to 3, the two pins 38, 39 are symmetrical and present in cross-section, when joined, a substantially egg-shaped shape, their sides being vertically extending.

The machine operates as follows:

First, the mobile arm 25 of the holder is opened to separate the two half-sockets 31, 32 and the core 35 is placed in a pipe of a circular cross-section such as shown at 44 in FIGS. 1 and 3. Then, the pipe provided with its core is placed in the half-sockets 31 and 32 and the mobile holder 25 is closed again, the mobile holder being locked by the nut 26. As shown in FIG. 1, the pipe 44 is thus applied against the flange 33 and tightened between the outer wall of the core 35 and the inner wall of the two half-sockets 31, 32, the pipe being thereby perfectly held.

In this position, the pins 38, 39 which are placed adjacent each other at the level of the pipe, are introduced therein. By feeding the cylinders 15, the slides 11, 12 are respectively moved along the arrows $f_1$, $f_2$ and the pins 38, 39 are separated; this has for its effect to deform the base of the pipe, as shown at 44*a* in phantom lines.

In the case of a straight pipe as that of FIG. 1, the two slides are simultaneously moved and by the same distance limited by the adjustable abutments 16, thus the pipe has then an opening 44*b* of an oblong shape as shown in FIG. 6. The distance of the deformation of course depends on the stroke of the slides 11, 12 and of the pistons 13, and is adjusted by the position of the abutments 16.

During the forming step, the pipe is perfectly held by the core 35 and the half-sockets 31, 32 so that the forming can be extremely accurate without any distortion of the portion of the tube which must remain circular.

FIGS. 1*a* and 1*b* show that an annular groove 31*b* can be formed in the half-sockets to enable:

either the housing of a corrugation 144 of the pipe 44, or to adapt, in the same holder 19, pipes of different heights through the provision of collars 33*a* or 33*b* having different heights.

The above described machine can be used in a similar way for forming oblique pipe. This is represented in FIGS. 4 and 5 according to which the pipe, then designated by $44_1$, has been cut at one end thereof in an oblique manner and consequently shows, at the end, an elliptical section. In that case, the fixed arm $20_1$ of the holder is shaped in the form of an angle in its portion applied against the block 18. The half-sockets $31_1$, $32_1$ are then placed obliquely as well as the mobile arm 25*a* of the holder and the core $35_1$.

The pins $38_1$ and $39_1$ are then supported by other parts $40_1$, $41_1$ positioned in the slides 11, 12 and the pins are provided for insertion into the elliptical opening of the pipe $41_1$, their lateral flanges being vertically extending.

In the case of an oblique pipe as that of FIGS. 4 and 5, the machine is in addition provided with a die 45 constituted by a plate fixed by bolts 46 in the flat recesses 37, 37*a* bordering the aperture 36 in the table 9 and having a concavity 47 in a shape corresponding to that of the pin $39_1$.

The way of positioning the oblique cross-section pipe $44_1$ and the operation of the machine are similar as those described in the above disclosure and, at the end of the work, the pipe $44_1$ is formed as shown in FIG. 7; i.e., its portion $44a_1$, shaped by the pins $38_1$, $39_1$ is of an oblong cross-section, the walls of this portion being vertically extending instead of being oblique as the remaining part of the pipe. The presence of the die 45 prevents any going up of the portion of wall designated by 44'.

FIGS. 4 and 5 show that the block 18, which supports the arms 20, 25 of the holder maintaining the pipe, is no longer rigidly fixed to the table 8 but can be moved and fixed in any point along an arc of circle of about 180°. A groove 48 or a slot has been provided for that purpose in the table 9 and blocking bolts 49 passing through the block 18 to fix it in any point of the groove 48. The center of the groove 48 is the same as the center of the two pins $38_1$, $39_1$ when the same are joined and then placed on the axis of the pipe. Then by moving the block 18 along the groove 48, the pipe $44_1$ is caused to rotate by the same distance, while holding its end, previously cut oblically, in the same horizontal plane. It is thus possible to form the oblong portion in any angular position as shown, as examples, at $44'_1$, $44'_2$, $44'_3$ in FIG. 8.

Figure 9:
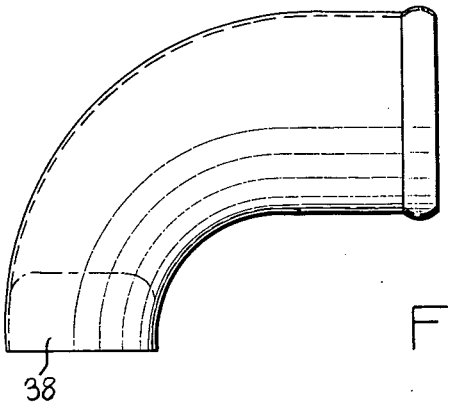
Figure 10:
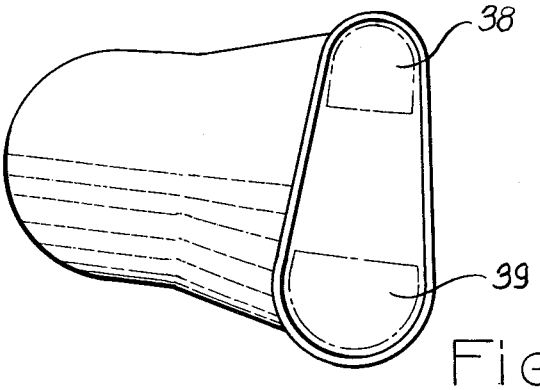
Figure 11:
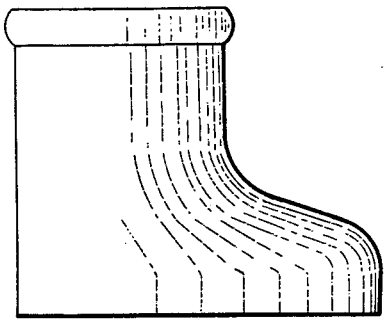

The holder 19 formed by the arms 20, 25 can be provided to support pipes previously bent as that of FIG. 9 and of which at least one of the ends must be made oblong. Also, the oblong shape is not the only one that is possible to be obtained with the machine of the invention. Actually, other forms can be provided and particularly forms substantially shaped as a trapezium with the small sides rounded as shown in FIG. 10. Then, the pins 38, 39 have only to be shaped in a form corresponding to the form to be obtained, one of the pins can easily have a width different from that of the other pin, as shown in phantom lines in FIG. 10. When a pipe must be shaped only on one side as represented in FIG. 11, then it suffices to immobilize one of the cylinders 15 by its abutment 16 and to adjust the other abutment 16 so that the stroke of the cylinder corresponds to or mates with the desired deformation. Also, the block 18 can in any case be fixedly mounted, but then the side thereof forming the groove 22 can be shaped as an arc of a circle concentric to the groove 48 and it is then the fixed arm 20 which becomes movable along the groove 22 of the block 18.

I claim:

1. A machine for forming one end of a pipe to be particularly used for heat exchangers so as to exhibit a substantially oblong opening, said oblong opening having a major axis forming any angle with respect to the longitudinal axis of said pipe, the machine comprising a fixedly mounted holder maintaining the pipe on whole periphery thereof in a position in which the end of the pipe which is to be formed is free and extends in a horizontal plane; two complementary or mating shaping pins adapted to be inserted into said free end of the pipe only; and pin supporting and driving means from which said pins protrude for moving said two pins on a trajectory in opposite directions for a distance corresponding to the deformation to be given to said end of the pipe; the machine further comprising at least one fixed die placed opposite at least one of the pins on the trajectory thereof.

2. Machine as set forth in claim 1, wherein the pins are externally connected to two coaxially guided slides, cylinders with piston rods being connected to said slides and positionable outside of the pipe.

3. Machine as set forth in claim 2, wherein the pins are connected to the slide through intermediate parts, thereby facilitating the interchange thereof.

4. Machine as set forth in claim 1, wherein the pins have substantially vertical sides, whereby the portion formed in the end of the pipe has substantially vertical walls whatever be the angle of the longitudinal axis of the holder with the pins.

5. Machine as set forth in claim 1, wherein said fixedly mounted holder of the pipe is removably connected to a supporting block.

6. Machine as set forth in claim 1, in which a core is placed inside the pipe, the machine comprising two half-sockets surrounding said pipe on a portion of the height thereof and held inside said holder, whereby the pipe is completely maintained between the core and the two half sockets.

7. Machine as set forth in claim 6, wherein said core is centered in the two half-sockets placed in the holder by means of collars.

8. Machine for forming one end of a pipe for heat exchangers so as to exhibit a substantially oblong opening, said oblong opening having a major axis forming any angle with respect to the longitudinal axis of said pipe, the machine comprising a fixedly mounted holder maintaining the pipe in a position in which the end thereof which is to be formed extends in a horizontal plane; two complementary or mating pins adapted to be inserted into said end of the pipe; supporting and driving means for moving said two pins in opposite directions for a distance corresponding to the deformation to be given to said end of the pipe, and an adjustable support on which the holder is mounted, said support being movable about an arc of a circle centered on the longitudinal axis of the holder, whereby the forming of said end of the pipe is made in any angular direction.

9. Machine for forming one end of a small pipe for a heat exchanger so as to exhibit a substantially oblong opening, said oblong opening having a major axis forming any angle with respect to the longitudinal axis of said pipe, the machine comprising a fixedly mounted holder maintaining the pipe in a position in which the end thereof which is to be formed extends in a horizontal plane; two complementary or mating pins adapted to be inserted into said end of the pipe; two coaxially guided slides to which said pins are externally connected; cylinders with piston rods connected to said slides, said cylinders with piston rods being positionable outside the pipe; supporting and driving means for moving said two pins in opposite directions for a distance corresponding to the deformation to be given to said end of the pipe; and abutments adjustably mounted in front of said cylinders to restrict the movements of said pins to the deformation to be given to said end of the pipe.

* * * * *